US005983954A

United States Patent [19]

Hasegawa

[11] Patent Number: 5,983,954

[45] Date of Patent: Nov. 16, 1999

[54] ROLLER TYPE WEFT YARN FEEDING DEVICE

[75] Inventor: Iwao Hasegawa, Tokyo, Japan

[73] Assignee: Micron Corporation, Tokyo, Japan

[21] Appl. No.: 08/976,093

[22] Filed: Nov. 21, 1997

[51] Int. Cl.[6] ..... D03D 47/34

[52] U.S. Cl. ..... 139/450; 139/452; 226/181; 242/610; 271/274

[58] Field of Search ..... 139/450, 452; 226/158, 181; 242/610, 610.6, 151, 900; 271/274

[56] References Cited

U.S. PATENT DOCUMENTS

| | | | |
|---|---|---|---|
| 3,926,224 | 12/1975 | Vermeulen et al. | 139/122 H |
| 4,303,107 | 12/1981 | Lucian et al. . | |
| 4,583,726 | 4/1986 | Nogi et al. | 271/4 |
| 4,589,451 | 5/1986 | Moesinger et al. | 139/452 |
| 4,799,516 | 1/1989 | Griffith | 139/455 |
| 4,875,611 | 10/1989 | Poehlein et al. | 226/186 |
| 4,921,155 | 5/1990 | Ito et al. | 226/181 |
| 5,645,275 | 7/1997 | Tranquilla | 271/274 |
| 5,794,664 | 4/1998 | Hasegawa et al. | 139/452 |

FOREIGN PATENT DOCUMENTS 51-58563 5/1976 Japan .

*Primary Examiner*—Andy Falik
*Attorney, Agent, or Firm*—Wenderoth, Lind & Ponack, L.L.P.

[57] ABSTRACT

A weft yarn feeding device includes a feed roller which rotates at a circumferential speed equal to a running speed of a weft and a pinch roller which moves in and out of contact with the circumference of the feed roller with the weft in between. The rollers are provided between a length measuring device and a main nozzle for injecting a fluid. Upon commencement of feeding of the weft, the feed roller and the pinch roller are brought into mutual pressure contact to positively feed the weft toward the main nozzle. Further, the feed roller surface has a large frictional coefficient and the pinch roller surface has a very small frictional coefficient.

7 Claims, 4 Drawing Sheets

ROLLER TYPE WEFT YARN FEEDING DEVICE

FIELD OF THE INVENTION

The present invention relates to a weft yarn feeding device for a fluid injection weaving machine, and more particularly, to a weft yarn feeding device which feeds a prescribed length of weft by increasing the frictional coefficient of the feed roller surface.

PRIOR ART DESCRIPTION

In a conventional weft yarn feeding device comprising a feed roller and a pinch rollers weft feeding is accomplished by releasing a stop claw of a length measuring device and bringing the feed roller into pressure contact with the pinch roller. The pinch roller is then rotated by the feed roller and the traction speed of the weft is gradually increased along with the rotation speed of the pinch roller. Further, the posture of the weft is controlled by means of a main nozzle and an auxiliary nozzle, and during this process, the pinch roller is moved away from the feed roller thereby subjecting the weft to only the pull of a fluid injecting energy from a sub-nozzle.

In this conventional practice, however, where the pinch roller is in pressure contact with the feed roller and rotates because of the feed roller, a difference in the circumferential speed between the feed roller and the pinch roller occurs during the initial period of pressure contact. In order to achieve a uniform feeding speed of weft, therefore, it is necessary to instantaneously minimize the difference in the circumferential speed between the pinch roller and the feed roller and improve the response thereof. With respect to the construction of the device, furthermore, the feed roller rotates at a high speed and the circumference thereof which serves as a transfer surface for the weft is required to be smooth. On the other hand, because the pinch roller holds the weft and attains the circumferential speed of the feed roller instantaneously when it comes into pressure contact with the feed roller, the pinch roller is conventionally lined with a material having a large frictional coefficient so that the weft is transported without slipping.

In such a conventional apparatus, however, the pinch roller which has a circumferential surface with a large frictional coefficient acts on a follower side of the weft and is rotated by the feed roller acting on a driving side of the weft and pulls and feeds the weft. During the initial stage of operation, therefore, the weft cannot be fed at a predetermined speed until the speed of the pinch roller reaches the circumferential speed of the feed roller, resulting in such defects as a large load on free running of the weft and uneven feed of the weft.

SUMMARY OF THE INVENTION

The present invention provides a weft yarn feeding device of a fluid injection weaving machine. The invention includes a feed roller which rotates at a circumferential speed equal to a flying speed of a weft. The invention also includes a pinch roller which moves in and out of contact with the circumference of the feed roller with the weft in between. The rollers are provided between a length measuring device and a main nozzle for injecting a fluid. Upon commencement of feed of the weft, the feed roller and the pinch roller are brought into mutual pressure contact to positively feed the weft toward the main nozzle. Further, a large frictional coefficient of the feed roller surface and a very small frictional coefficient of the pinch roller surface are used to feed the weft at the circumferential speed of the feed roller.

According to the present invention the surface of the rotating feed roller which is pressed against the driving side of the weft is coated with a material having a large frictional coefficient. The pressure contact surface of the pinch roller has, on the other hand, a very small frictional coefficient of a negligible order. The weft is simply held therebetween and pressure is applied to facilitate operations. The weft is thus fed at the predetermined circumferential speed of the feed roller by the friction and pressure contact between the pinch roller and the feed roller to permit feeding of the weft by a length corresponding to the circumferential length of the feed roller.

DETAILED DESCRIPTION OF THE INVENTION

Figure 1:
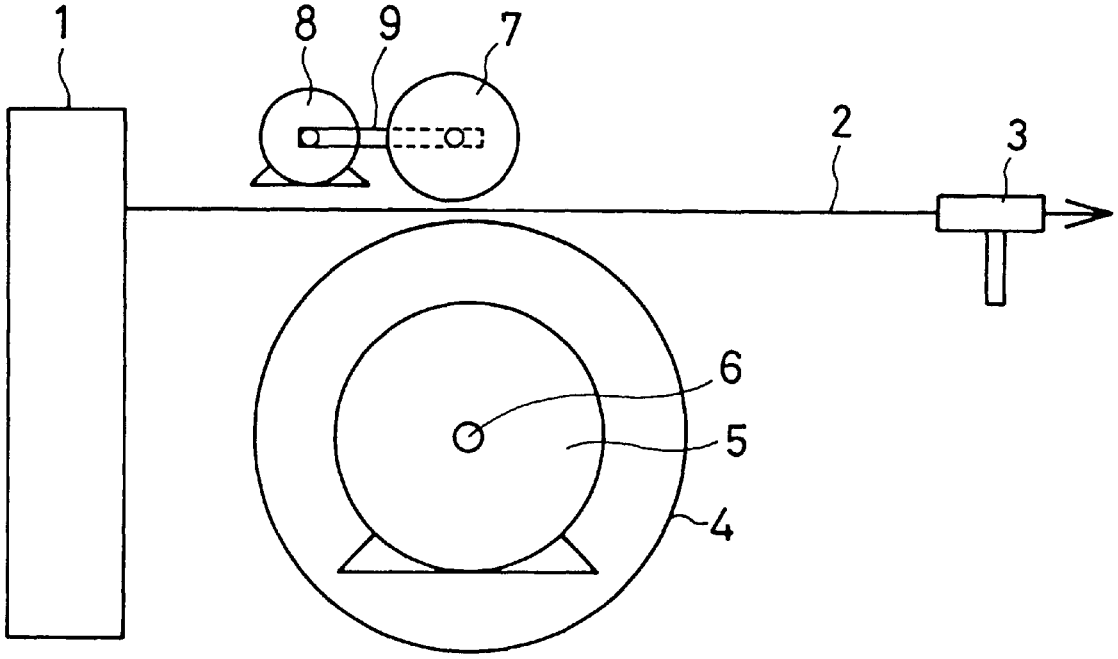
FIG. 1 shows a schematic view of a weft yarn feeding device of the invention.

The invention provides a weft yarn feeding device for a fluid injection weaving machine. The invention includes a feed roller which rotates at a circumferential speed equal to a feeding speed of a weft. The invention also includes a pinch roller which moves in and out of contact with the circumference of the feed roller with the weft in between. The rollers are provided between a length measuring device and a main nozzle for injecting a fluid. Upon commencement of feeding of the weft, the feed roller and the pinch roller are brought into mutual pressure contact to positively feed the weft toward the main nozzle. Further, a large frictional coefficient of the feed roller surface and a very small frictional coefficient of the pinch roller surface are used to feed the weft at a circumferential speed equal to the circumferential speed of the feed roller. According to the invention, the surface of the rotating feed roller which is used to drive the weft is coated with a material having a large frictional coefficient. The pressure contact surface of the pinch roller has, on the other hand, a very small frictional coefficient of a negligible order. The weft is simply held therebetween and pressure is applied to facilitate operations. The weft is thus fed at the predetermined circumferential speed of the feed roller by the frictional and pressure contact between the pinch roller and the feed roller to permit feeding of the weft by a length corresponding to the rotation of the feed roller. The feed roller having a surface uniformly lined with a material having a large frictional coefficient and a high durability such as urethane rubber is employed. On the other hand, a material having an extremely small frictional coefficient is used for the pinch roller. If, however, the pinch roller is rotatable, it is not necessary for its frictional coefficient to be extremely small. It suffices in this case that the inertia moment is the smallest possible and the pinch roller is finished to be wear resistant. According to the weft motion of such a construction, pressure contact between the pinch roller and the feed roller makes it possible for the weft to be fed by the feed roller by only holding the weft between the pinch roller and the feed roller. No delay in pulling the weft results from the difference in the circumferential speed between the feed roller and the pinch roller at the beginning of feeding as has been suffered in the conventional apparatus. In feeding the weft, the pinch roller comes into pressure contact with the feed roller immediately upon release of a stop claw of the length measuring device, and the weft is positively fed by a length corresponding to the circumferential length of the feed roller. The weft is fed by the action of the previously operated main nozzle and an auxiliary nozzle. The pinch roller is separated immediately before the step claw is dropped, thus completing the weft feeding.

The invention also provides a yarn feeding device for a fluid injection weaving machine, in which brake imparting means for incrementally reducing the flying speed of the weft when the pinch roller causing the weft motion moves apart from the feed roller. The invention is provided between a length measuring device and a feed roller. Upon feeding the weft, tension caused by injection of fluid is applied to the weft and upon completion of the feeding operation of the weft by the feed roller, the excessive tension applied to the weft can be alleviated by braking, thus limiting the motion of the weft in the running direction.

The invention also provides a weft yarn feeding device in which the brake imparting means constitutes a braking plate in mechanical linkage with the pinch roller bringing about the same effects as the invention discussed above.

The invention also provides a weft yarn feeding device in which the brake imparting means constitute a compressed air reverse injecting nozzle which temporarily injects compressed air in a direction opposing movement of the weft. It is therefore possible to smoothly absorb the energy of motion of the weft in the running direction and reduce the running speed of the weft by injecting air to brake motion of the weft.

Now, a few embodiments of the present invention will be described with reference to FIGS. 1 to 4.

Embodiment 1

FIG. 1 illustrates a weft yarn feeding device of a first embodiment of the invention. In FIG. 1, (3) is a main nozzle. A feed roller (4) which is rotatably connected by a bearing to a motor shaft (6) of the motor (5) defines a weft path between the main nozzle (3) an a length measuring device (1). The outer circumference of the feed roller (4) is uniformly lined with a durable material having a large frictional coefficient such as urethane rubber. A pinch roller (7) moves in and out of contact with the feed roller (4) by the action of a solenoid (8) attached to an end of a connecting arm (9). The outer circumference of the pinch roller is coated with a material having an extremely small frictional coefficient such as a mirror-surface-treated surface.

Figure 2:
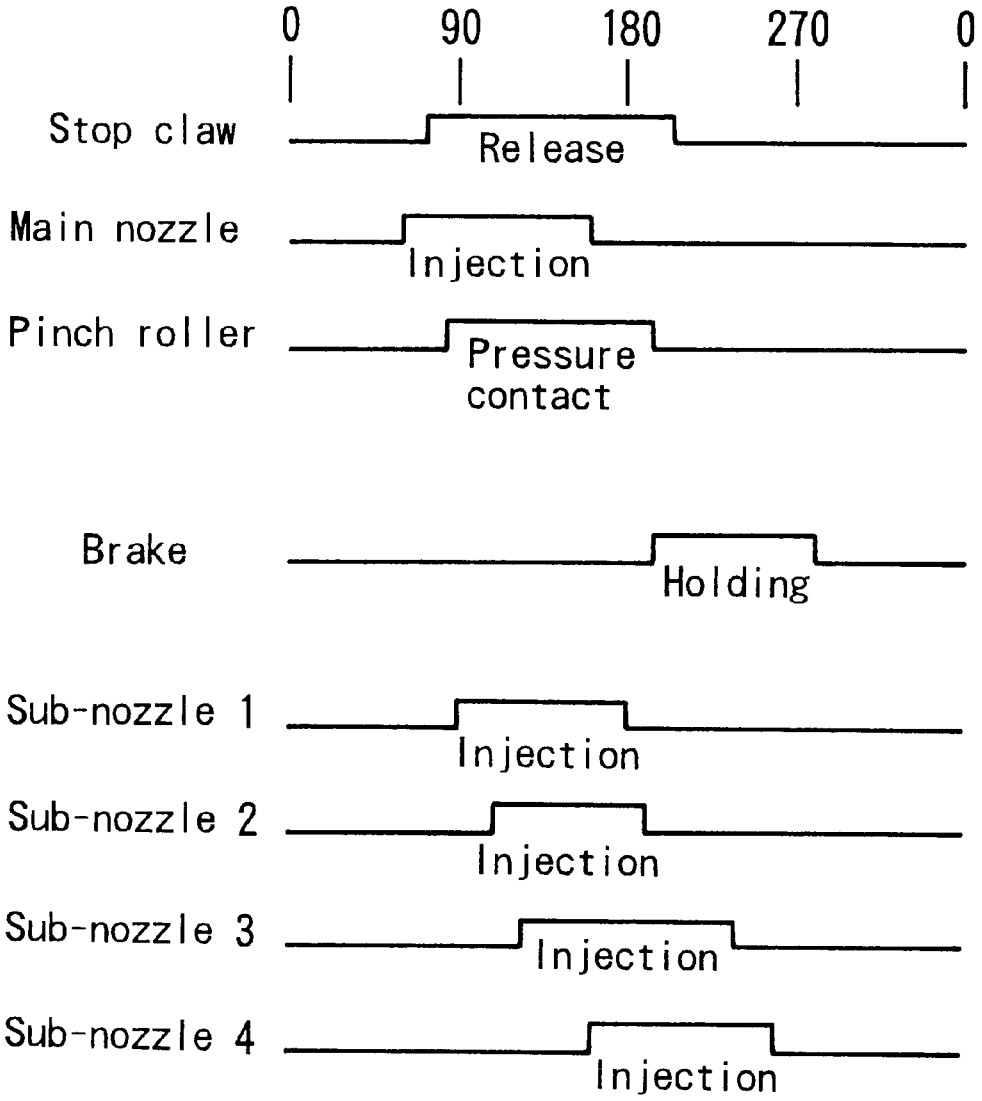
FIG. 2 shows a timing chart.

Functions of the embodiment of the invention will now be described below. FIG. 2 illustrates timing of reed motion, warp opening, weft feeding and counting. Weft feeding and counting are conducted in accordance with a procedure shown in this timing chart. Upon turning on a loom, oscillation of the reed commences counting, one count per rotation of the main shaft of the loom. The weft performs opening of upper and lower yarns alternately.

First, the nozzle (3) is turned on when the warp forms an opening, and begins injection to commence weft feeding. At this point, a stop claw of the length measuring device (1) releases the weft, and at the same time, the solenoid (8) is turned on, causing the pinch roller (7) to come into contact with the feed roller (4).

The weft (2) is held between the feed roller (4) and the pinch roller (7) and runs toward the nozzle (3) by a length corresponding to the rotation of the feed roller (4). The weft travels at a circumferential speed of the feed roller under the effect of frictional force between the weft and the feed roller (4). The weft is inserted into an opening of the warp by the nozzle (3) which has started injection, thus feeding the weft.

In the present invention, as described above, the surface of the rotating feed roller has a large frictional coefficient, and the pressure-contact surface of the pinch roller has a very small frictional coefficient of a negligible order. The weft is simply held between these rollers subjected only to pressure. The weft is therefore fed by the feed roller by a length corresponding to the circumferential length of the roller.

Figure 3:
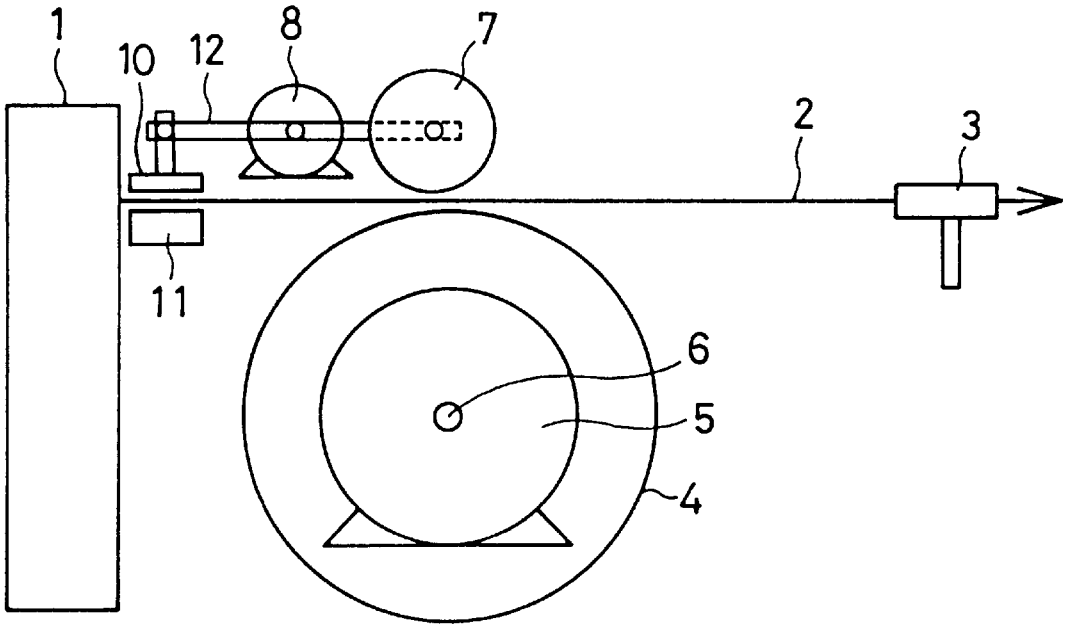
FIG. 3 shows a schematic view of another embodiment of the weft yarn feeding device of the invention.
Figure 4:
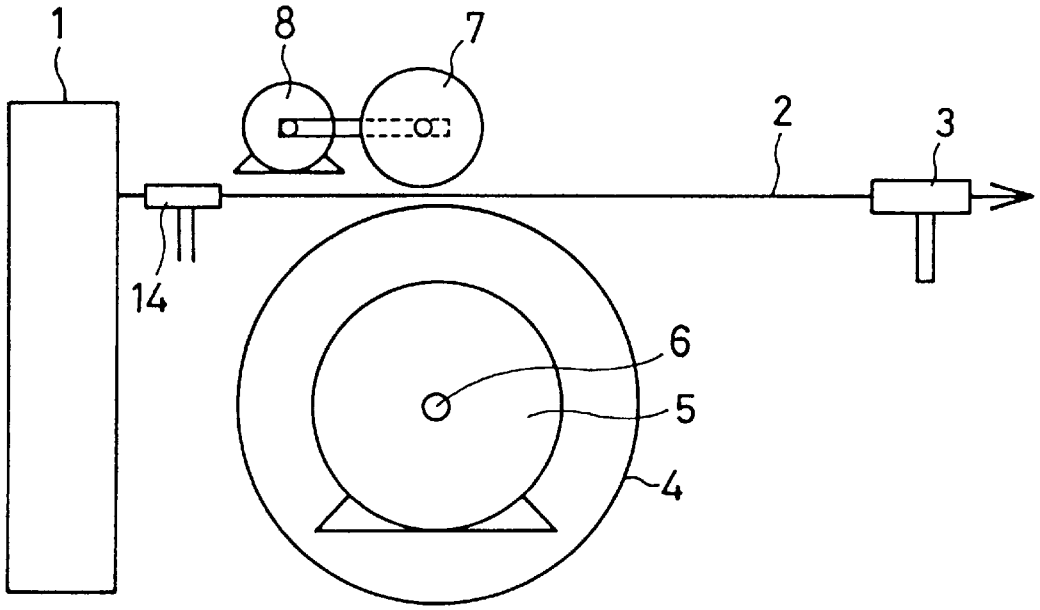
FIG. 4 shows a schematic view of yet another embodiment of the yarn feeding device of the invention.

FIGS. 3 and 4 illustrate other embodiments of the invention incorporating brake imparting means for braking motion of the weft. FIG. 3 illustrates the brake imparting means utilizing mechanical linkage means, and FIG. 4 shows brake imparting means utilizing a compressed air reverse injecting nozzle.

In FIG. 3, the brake imparting means includes a braking plate (10) and a brake seat (11). The brake imparting means is provided at a side of the length measuring device (1) and between the length measuring device (1) and the feed roller (4). The braking plate (10) is attached to an end of a connecting arm (12) of a rotary solenoid (8) so that the brake imparting means is mechanically linked to and operates with the pinch roller (7). The pinch roller is provided at the other end of the connecting arm (12) and also operates under the action of the rotary solenoid (8). The contact surface between the brake imparting means and the weft is surface-treated with, for example, a DLC coat by the ion evaporation method to reduce surface friction and, as a result, inhibit a rapid increase in tension upon clamping the weft. Further, with a view to alleviating operation of the braking plate (10), current is fed in + and – directions to the rotary solenoid (8) to control by a PWM (Pulse Width Modulation) method based on current control in + and – directions. This alleviates initial operation of the braking plate (10) and incrementally reduces the weft running speed, thus preventing occurrence of an excessive tension applied to the weft and decreases instances where the weft is broken.

FIG. 4 illustrates the provision of a compressed air reverse injection nozzle (14) serving as the weft brake imparting means.

The reverse injecting nozzle (14) is designed to inject compressed air in a direction opposing the running direction of the weft (2) when the weft is not being fed in which the pinch roller (7) is not in contact with the feed roller (4). The reverse injecting nozzle (14) operates in conjunction with the pinch roller (7). Because a mechanical control force is not applied to the weft, in this embodiment, the weft is not placed in excessive tension, thus permitting reduction of the running speed.

The present invention provides a weft yarn feeding device for a fluid injection weaving machine, including a feed roller rotating at a circumferential speed equal to a running speed of a weft. The invention also includes a pinch roller which comes in and out of contact with the circumference of the feed roller with the weft in between. The invention is provided between a length measuring device and a main nozzle for injecting a fluid. Upon commencement of feeding of the weft, the feed roller and the pinch roller are brought into mutual pressure contact to positively feed the weft toward the main nozzle. The feed roller surface has a large frictional coefficient and the pinch roller surface has a small frictional coefficient, thus the weft is fed at a circumferential speed of the feed roller. The pinch roller simply holds the weft, and serves only to apply pressure. The weft is fed by the frictional force of the feed roller. It is therefore possible to feed the weft always at a constant speed by a length corresponding to the circumferential length of the feed roller by the action of the feed roller.

As a result, there is no difference in the feed speed of the weft which in the prior art had been caused by the difference in the circumferential speed between the feed roller and the pinch roller. Upon weft feeding, when the pinch roller comes into pressure contact with the feed roller, the weft is positively fed at the circumferential speed of the feed roller by a length corresponding to the circumferential length thereof. Thus, weft feeding is accomplished by the injecting main nozzle and the auxiliary nozzle.

Further, because brake imparting means for incrementally reducing the weft feeding speed are provided between the length measuring device and the feed roller, it is possible to incrementally impart braking force for controlling the motion of the weft in the running direction and thus possible to alleviate an excessive tension applied to the weft upon stoppage of the weft.

What is claimed is:

1. A weft yarn feeding device for use in a fluid injection weaving machine, comprising:

a length measuring device for measuring a length of weft to be fed;

a fluid injection nozzle for feeding the weft into the fluid injection weaving machine;

a feed roller having a contact surface for contacting the weft, said feed roller being positioned between said length measuring device and said fluid injection nozzle, said feed roller being rotatable at a desired weft feeding speed;

a pinch roller having a contact surface for contacting the weft, said pinch roller being mounted for movement toward and away from said feed roller to pinch the weft between said pinch roller and said contact surface of said feed roller such that weft pinched between said pinch roller and said contact surface of said feed roller is fed toward said fluid injection nozzle at the desired weft feeding speed; and a solenoid operably connected with said pinch roller to move said pinch roller toward and away from said feed roller;

wherein said contact surface of said feed roller has a coefficient of friction which is greater than a coefficient of friction of said contact surface of said pinch roller.

2. The weft yarn feeding device of claim 1, further comprising:

a brake operably positioned between said length measuring device and said feed roller to incrementally reduce the weft feeding speed as said pinch roller is moved away from said feed roller.

3. The weft yarn feeding device of claim 2, wherein said brake comprises:

a braking plate mechanically linked to said pinch roller.

4. The weft yarn feeding device of claim 2, wherein said brake comprises:

a compressed air reverse injecting nozzle which is operable to temporarily inject compressed air in a direction opposite a traveling direction of the weft.

5. The weft yarn feeding device of claim 1, wherein:

said solenoid is a rotary solenoid.

6. The weft yarn feeding device of claim 5, wherein:

said coefficient of friction of said contact surface of said feed roller is large; and said coefficient of friction of said contact surface of said pinch roller is extremely small.

7. The weft yarn feeding device of claim 5, wherein:

said contact surface of said feed roller comprises urethane rubber.

* * * * *